United States Patent [19]

Kelly et al.

[11] 4,423,692

[45] Jan. 3, 1984

[54] PNEUMATIC NEEDLE POSITIONER

[75] Inventors: James C. Kelly; Fredrick W. Garnett, both of Starkville, Miss.

[73] Assignee: Starkville Tool and Die Company, Starkville, Miss.

[21] Appl. No.: 283,809

[22] Filed: Jul. 16, 1981

[51] Int. Cl.[3] ..... D05B 69/22

[52] U.S. Cl. ..... 112/274; 112/220; 112/276; 74/661

[58] Field of Search ..... 112/220, 274, 276; 74/661, 665 A, 665 B

[56] References Cited

U.S. PATENT DOCUMENTS

| | | | |
|---|---|---|---|
| 2,985,270 | 5/1961 | Landeros | 112/274 X |
| 3,977,339 | 8/1976 | Tice | 112/274 |
| 4,228,749 | 10/1980 | Pugliese | 112/274 |

*Primary Examiner*—Werner H. Schroeder
*Assistant Examiner*—Andrew M. Falik
*Attorney, Agent, or Firm*—Breneman, Kane & Georges

[57] ABSTRACT

A pneumatic needle positioner for positioning a needle of sewing and stitching machines in a predetermined position in the sewing or stitching cycle is provided by utilizing a handwheel sensing device in cooperation with a pneumatically powered positioning motor engageably disposed relative to a drive V-belt which engages the V-belt with a V-belt pulley of the pneumatic needle positioning motor at the end of the sewing cycle, by the actuation of a biasing piston having a roller to tension the V-belt toward the pulley disposed on the pneumatically powered positioning motor. Preferably the biasing piston and roller for the pneumatically powered positioning motor is disposed slightly above or below an axially adjacent position to the air motor pulley to provide a sinesoidal shaped bias against the pnematically powered positioning motor pulley to more effectively cooperate with the positioning device to achieve a more reliable and accurate positioning of the needle. The cooperation and disposition of the pneumatically powered positioning motor in cooperation with the biasing piston device and handwheel positioning device provides a simplified, yet reliable and economical needle positioning apparatus for a variety of sewing and stitching machines which may be utilized in new equipment or readily added to existing machinery to enhance the accuracy or the positioning of the sewing needle in the sewing or stitching cycle.

25 Claims, 8 Drawing Figures

PNEUMATIC NEEDLE POSITIONER

BACKGROUND OF THE INVENTION

1. Field of the Invention

The present invention pertains to a pneumatically powered needle positioner for a variety of sewing and stitching machines which positions a sewing machine needle at a predetermined position in the sewing cycle by employing a pneumatically powered needle positioning motor in cooperation with a V-belt biasing piston including a roller and a hand wheel positioning means. More particularly the invention relates to the addition of a pneumatically powered needle positioning motor adjacent to a V-belt between the sewing machine and drive motor and employs a biasing piston and roller for bending the V-belt around a portion of the circumference of a pulley on the pneumatically powered needle positioning motor which upon activation positions the needle at the end of the sewing cycle.

The pneumatically controlled positioning motor is designed to cooperate with one or more handwheel sensing means for sensing the position of a sewing machine handwheel which has been calibrated to correspond to desired predetermined positions of the needle in the sewing cycle. The novel disposition and utilization of the pneumatically powered needle positioning motor in cooperation with the V-belt biasing piston and roller serves to provide a more efficient and reliable system for more precisely positioning the needle at a predetermined point with respect to the sewing cycle. The utilization of the V-belt biasing piston and roller in cooperation with the pneumatically powered air motor pulley and a simplified handwheel sensing means efficiently cooperates to simplify and facilitate the addition of an inexpensive needle positioner on new equipment or the easy modification of existing equipment to accomodate the novel needle positioner.

2. Description of the Prior Art

The prior art includes a variety of devices illustrating a myriad of needle positioners and positioning devices for positioning needles for sewing machines and stitchers. The effectiveness and adoption of any particular needle positioner in the industry is a function not only of the effectiveness of the needle positioner to repeatedly position a needle at a predetermined point in the sewing cycle but also the cost and compatability of the needle positioner with existing stitching and sewing machinery. As pointed out in Tice U.S. Pat. No. 3,924,553 (col. 1, lines 40–53) many of the available electrical devices are susceptible to maladjustment thereby requiring high initial cost and inordinate amounts of maintenance. In addition recent developments in the garment industry have pointed to the advantages of combining electrical systems with pneumatically powered systems to increase the reliability and efficiency of the entire mechanical system.

The present invention like the pneumatically powered positioning apparatus of Tice U.S. Pat. No. 3,924,553 employs the combination of an electrically actuated stitching or sewing apparatus with a pneumatically powered needle positioner for automatically positioning the needle in a predetermined position in the sewing cycle.

The prior art such as Tice U.S. Pat. No. 3,924,553, however, pertains to a pneumatically powered needle positioner in combination with an electrically activated stitching machine that requires a fairly extensive modification of existing stitching or sewing machinery in comparison with the pneumatically powered needle positioner of the present invention. More particularly in Tice U.S. Pat. No. 3,924,553 and in Tice U.S. Pat. No. 3,977,339 a sophisticated combination and disposition of pneumatically powered motors in combination with cam means along with continued engagement of the air motor pulley fixed to the main drive shaft is required to provide an apparatus for positioning a needle in the sewing cycle. As a consequence, it will be recognized by those skilled in the art the present invention provides a simplified and therefore an economically and mechanically advantageous pneumatically powered needle positioner that utilizes a minimum of elements to provide advantages over prior art needle positioners.

More particularly the pneumatically powered needle positioner of the present invention utilizes the sewing machine, electric motor and V-belt combination of sewing machines that are standard in the industry. The present needle positioner is achieved by merely the substitution or modification of an existing handwheel to provide a handwheel sensing means which cooperates with a pneumatically powered needle positioning motor and biasing roller and piston combination to position the needle in a predetermined position in the sewing cycle. The configuration and novel arrangement of the pneumatically powered needle positioning motor in cooperation with the V-belt and biasing piston and roller combination serves to efficiently utilize and control the positioning of the needle in the sewing cycle.

SUMMARY OF THE INVENTION

The disadvantages and limitation of prior art needle positioning devices including the problem of the compatibility and application of a needle positioner to existing sewing and stitching equipment presently utilized in the industry is obviated by the utilization of the pneumatically powered needle positioner of the present invention. The novel pneumatically powered needle positioner may be conveniently added at the factory to new equipment or readily added to existing sewing and stitching machinery by requiring minimal modification of existing machinery to provide an effective and economical needle positioner.

The present pneumatically powered needle positioner is provided by utilizing the traditional sewing machine electric motor and sewing machine V-belt combination. A pneumatically controlled needle positioning motor is added to the traditional sewing machine motor V-belt combination by disposing the pneumatically controlled needle positioning motor adjacent to and preferably intermediate to the sewing machine handwheel and the electrically powered motor pulley at a position corresponding to a slack area in the V-belt pulley combination. In sewing operation the pneumatic needle positioning motor and the pulley for driving the V-belt combination is not in engagement with the V-belt. In accordance with the present invention the pneumatically powered needle positioning motor and drive pulley disposed thereon is only brought into contact with the V-belt when positioning of the needle in or out of the fabric is desired. At that time a piston with a V-belt biasing roller is extended to contact the V-belt and bend the V-belt around a portion of the circumference of a pulley disposed on the needle positioning motor which turns the V-belt pulley combination once the sewing machine motor and any brake assembly of the electric motor for powering the sewing machine in its sewing configuration has been disengaged.

The pneumatically powered needle positioning motor is thereafter engaged to turn the V-belt and the sewing machine until a means for locating position on a handwheel of the sewing machine determines the position of the handwheel which corresponds to a predetermined position of the needle in the sewing cycle. Once the predetermined needle position is attained the piston and roller combination for bending the V-belt around a portion of the pulley on the needle positioning motor are disengaged to return the V-belt to the sewing configuration and thereby completely disengage the needle positioning motor.

The pneumatically powered needle positioning motor cooperates with a means for determining position of the handwheel of the sewing machine which is calibrated to correspond to the position of the needle in the sewing cycle. Preferably a position is marked on the handwheel to indicate a point in the sewing cycle at which the needle is fully out of the fabric or a position in which the needle is fully engaged in the fabric. In a single needle position embodiment a single sensor or needle position indicator may be employed which preferrably cooperates with the sewing machine handwheel to indicate the needle position. Where a two position needle positioner is desired it is possible to mark these positions in a variety of ways. These positions may be marked by utilizing two separate sensors and a single marking or multiple markings and a single sensor or a second handwheel and two sensors or combinations thereof available to those skilled in the art. As a consequence at least one sensing means is provided for determining the position of the needle by marking the sewing machine handwheel to provide information as to whether the sewing machine needle is positioned completely in the fabric or outside of the fabric.

In most industrial sewing machines on the market a standard motor brake and clutch arm is utilized to stop the sewing machine and reduce the ease or tendency for further rotation of the handwheel after the termination of the sewing operation. In such sewing machine combinations the needle positioner of the present invention contemplates a further piston and cylinder combination which may be employed at the end of the sewing cycle to extend and release the brake of the standard sewing machine motor to thereby allow the V-belt to be turned more readily by the pneumatically controlled needle positioning motor. Failure to disengage the brake of the sewing machine motor would not completely interfere with the apparatus or method of the present invention but would require a larger pneumatically controlled needle positioning motor and/or extra energy would have to be exerted to overcome the force of the brake utilized in the standard sewing machine motor. As a consequence it will be recognized that a means for disengaging the brake of the motor brake and clutch arm of the sewing machine drive motor optimally should be utilized in most industrial sewing machine combinations which utilize the brake assembly to stop the sewing machine once power has been interrupted to the sewing machine motor.

The disposition and arrangement of the components of the novel needle positioner provide multiple advantages over the prior art needle positioning devices by reducing cost, wear and maintenance and by providing a simplicity of operation that is not found in prior art needle positioning devices. The needle positioner of the present invention furthermore will require less power in operation since, when it is not needed it does not interfere with the normal operation of the sewing machine. Moreover as a consequence of its design and the arrangement of the components of the novel needle positioner, the present needle positioner can be easily added to existing equipment to reduce maintenance problems while providing an accurate device for positioning a needle at a predetermined point in the sewing cycle.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
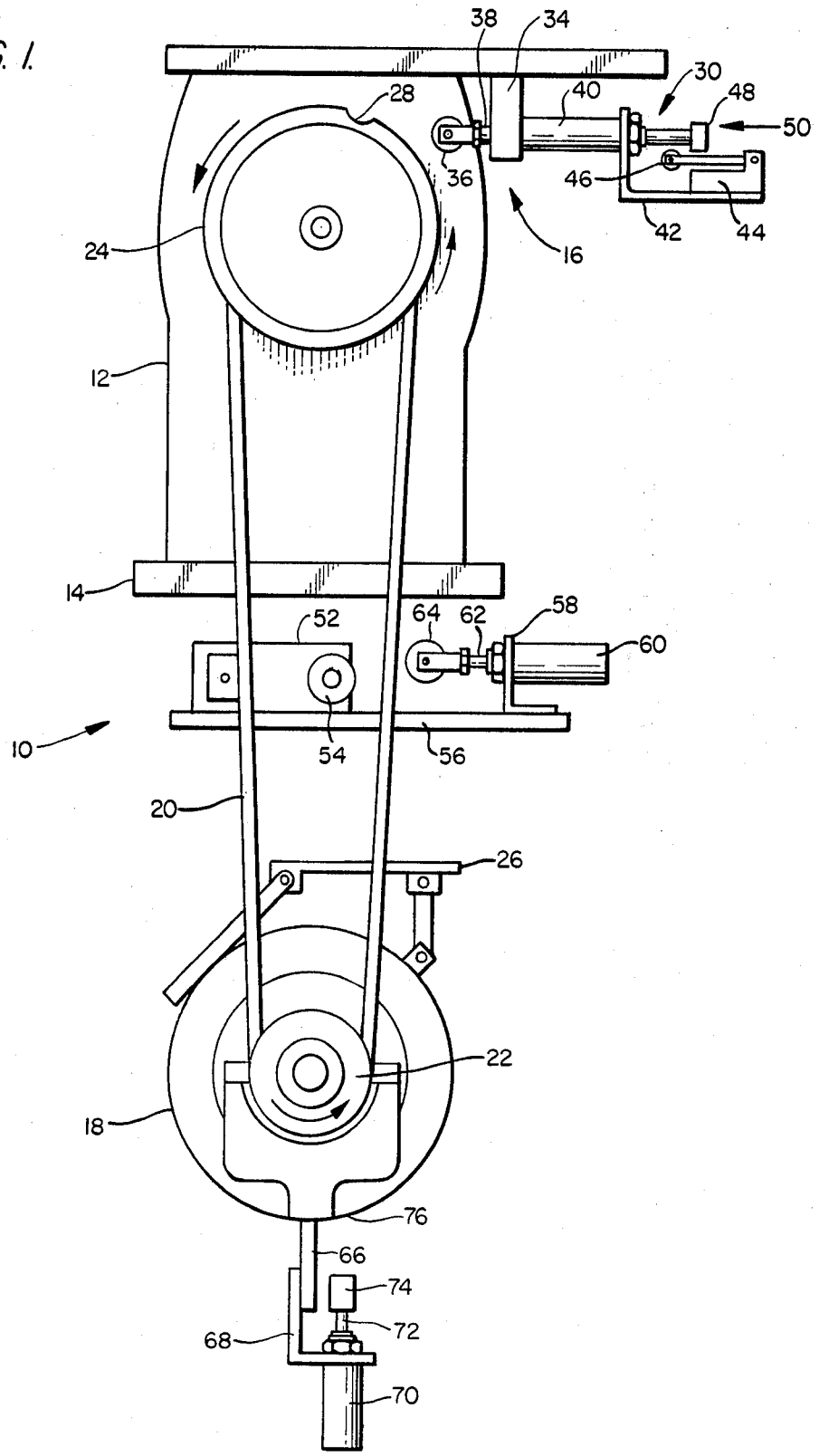
FIG. 1 is a side elevational view illustrating an arrangement for a needle positioner including a disposition of a needle positioning motor with respect to a sewing machine and drive motor in the sewing configuration.

Referring now to FIG. 1 a pneumatically powered needle positioner 10 is illustrated in association with a typical industrial sewing machine in its sewing configuration. The sewing machine 12 depicted is supported by a table 14 which is supported by a frame (not shown) which maintains a sewing machine drive motor 18 in a predetermined position with respect to sewing machine 12. A drive V-belt 20 is employed to provide drive power from a pulley 22 disposed on the drive motor 18 to the sewing machine handwheel 24. Sewing machine drive motor 18 is fixed with respect to sewing machine 12 by a frame (not shown) which supports motor 18 by a hinged platform 26. Sewing machine drive motor 18 is ordinarily powered by electricity and the sewing machine garment foot is generally raised or lowered mechanically. The raising and lowering of the pressure foot of the sewing machine in some instances has been replaced by air cylinders which raise and lower the sewing machine pressure foot. In such equipment the present invention is particularly adaptable since the air pressure for raising and controlling the mechanical pressure foot of the machine and other aspects of the sewing operation can conveniently be utilized to provide power for the present pneumatically controlled needle positioner.

As will be recognized from FIG. 1 the present needle positioner in a sewing operation does not impede or interfere with the normal operation of the sewing machine. The needle positioner of the invention may be supplied as a unit for new machinery or may be conveniently added to existing equipment already in use by the addition and modification of various elements of the standard sewing machine combinations.

In accordance with the invention the handwheel 24 is modified or replaced with a handwheel having an identification mark or means for locating a particular point along the circumference of the handwheel. In FIG. 1 an identification indentation 28 is placed on the handwheel 24 and is designed to cooperate with a handwheel position sensing means 16 which conveniently may be a pneumatically actuated piston cylinder combination 30 disposed stationary with respect to the sewing machine 12 by a mounting bracket 34. The pneumatically powered piston cylinder combination 30 cooperates with indentation 28 to provide a handwheel position sensing means 16 which upon actuation by the utilization of a roller 36 disposed on piston 38 cooperates with air cylinder 40 in a manner well known to those skilled in the art. Disposed on cylinder 40 is a switch mounting bracket 42 which carries a contact switch 44 having a roller 46 designed to engage a corresponding contact 48 on piston 38 when piston 38 is fully extended in the direction of arrow 50 and engages indentation 28 as will be described hereinafter in greater detail.

A needle positioning motor 52 in the preferred embodiment is disposed intermediate pulley 22 of an electric sewing machine drive motor 18 and handwheel 24 in line with and adjacent to the V-belt 20. As will be recognized by those skilled in the art needle positioning motor 52 is disposed a distance adjacent to V-belt 20 commensurate with the amount of slack available in the V-belt. Needle positioning motor 52 is pneumatically controlled and activated and includes a V-belt engaging pulley 54 for engaging V-belt 20 in a manner as will be described hereinafter in greater detail. Pneumatically powered positioning motor 52 is supported with respect to sewing machine 12 and motor 18 on a platform 56 which itself is supported by the frame (not shown) supporting sewing machine 12 and motor 18.

Support platform 56 also supports a mounting bracket 58 for mounting a pneumatically controlled cylinder 60 which extends and retracts a piston 62 having a roller 64 mounted thereon for contacting V-belt 20 and bending the V-belt around a portion of the circumference of pulley 54 of the needle positioning motor 52. In the preferred embodiment of the invention roller 64 is not disposed horizontally adjacent to the center line between the roller 64 and pulley 54 but instead is disposed slightly above or below a horizontal center line to assist in biasing and increasing the efficiency of pulley 54 in the needle positioning operation of the needle positioning motor 52. Preferrably roller 64 is $\frac{3}{4}$ of an inch above or below the center line of pulley 54 which is driven by a 3 to 1 gear ratio to provide a sinesoidal shaped path of travel for V-belt 20 to give V-belt 20 more circumference to position handwheel 24 more accurately.

A further modification is preferably utilized with respect to sewing machines utilizing a standard motor 18 which has a motor brake assembly 66 as is traditionally utilized in industrial sewing machines. In such sewing machines a mounting bracket 68 is attached to the brake assembly 66 and supports a further air actuated cylinder 70 which extends and retracts a piston 72 having flat supporting head 74. The purpose of cylinder 70 and piston 72 in motors utilizing a standard motor brake and clutch assembly is to provide a means for releasing the brake once sewing machine drive motor 18 has been stopped.

In sewing machine motors generally in use the brake assembly remains on motor 18 until electric current is again supplied to motor 18.

The brake of motor 18 (industrial sewing machines) and motor 140 (stitching machines FIG. 5) is a component of the unit inside the housing of the electric motor and is automatically activated when current to the electric motor is interrupted so as to prevent the continued sewing which would otherwise result from the inertia of the electric motor. These standard brakes of various manufacturers of sewing and stitching machine motors may be released mechanically by exerting pressure between the brake arm or assembly 66 and the motor housing. The pneumatic extension of piston 72 (FIG. 2) serves to contact housing surface 76 of motor 18 to release the brake inside the motor housing and thereby allow the needle positioning motor 52 to position the needle without having to operate against the brake of motor 18 as will be described hereinafter in further detail. As will be recognized by those skilled in the art from FIG. 1 the needle positioner of the present invention employs a minimal modification and number of parts necessary to provide for the efficient positioning of the sewing machine needle in sewing machine equipment. In addition the present needle positioner provides a number of advantages since it is pneumatically powered and is easily made compatible with more sophisticated equipment which is also pneumatically controlled.

Figure 2:
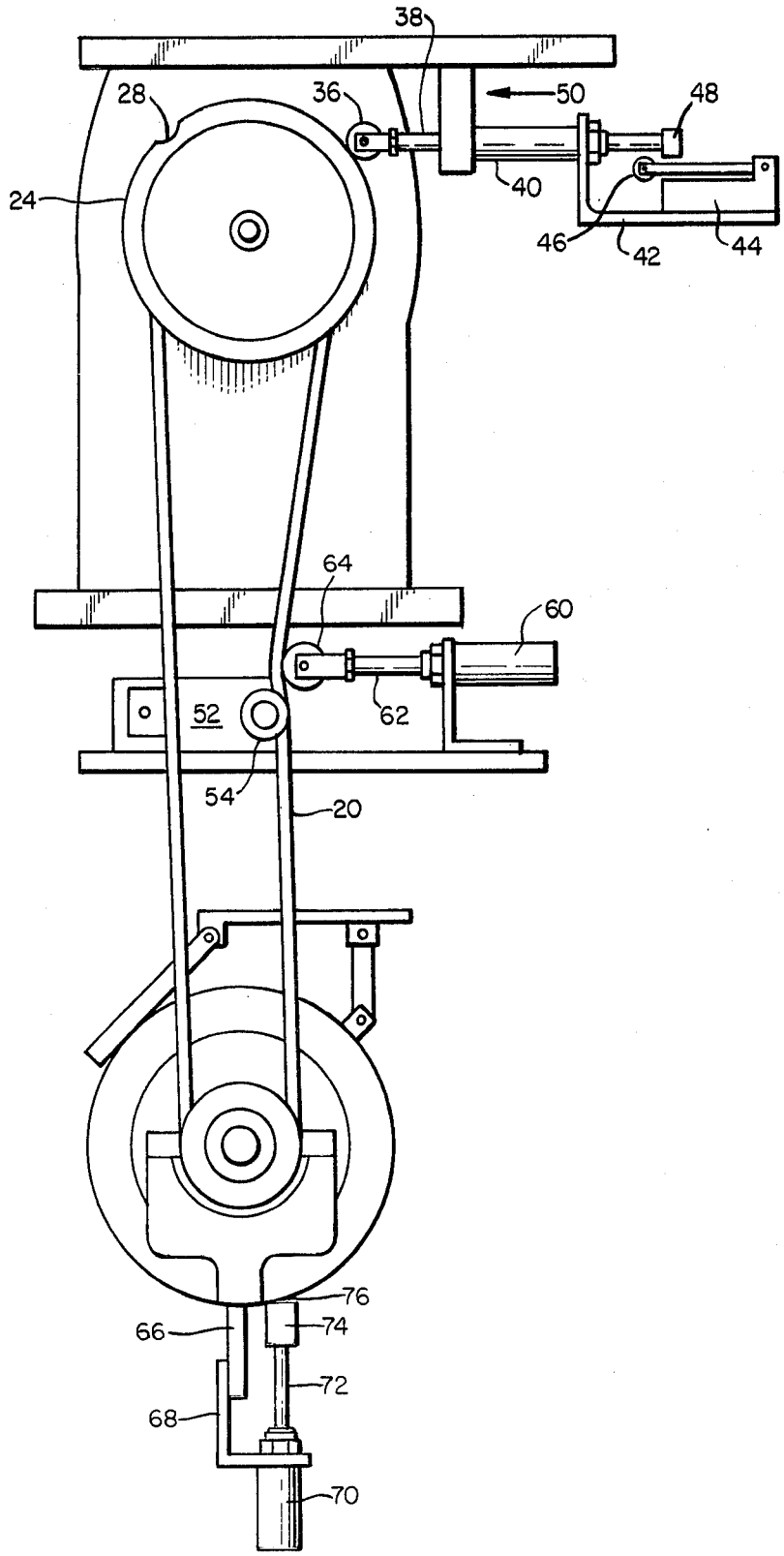
FIG. 2 is a side elevational view similar to FIG. 1 illustrating the engagement of the needle positioning motor and the positioning operation of the needle positioner.
Figure 3:
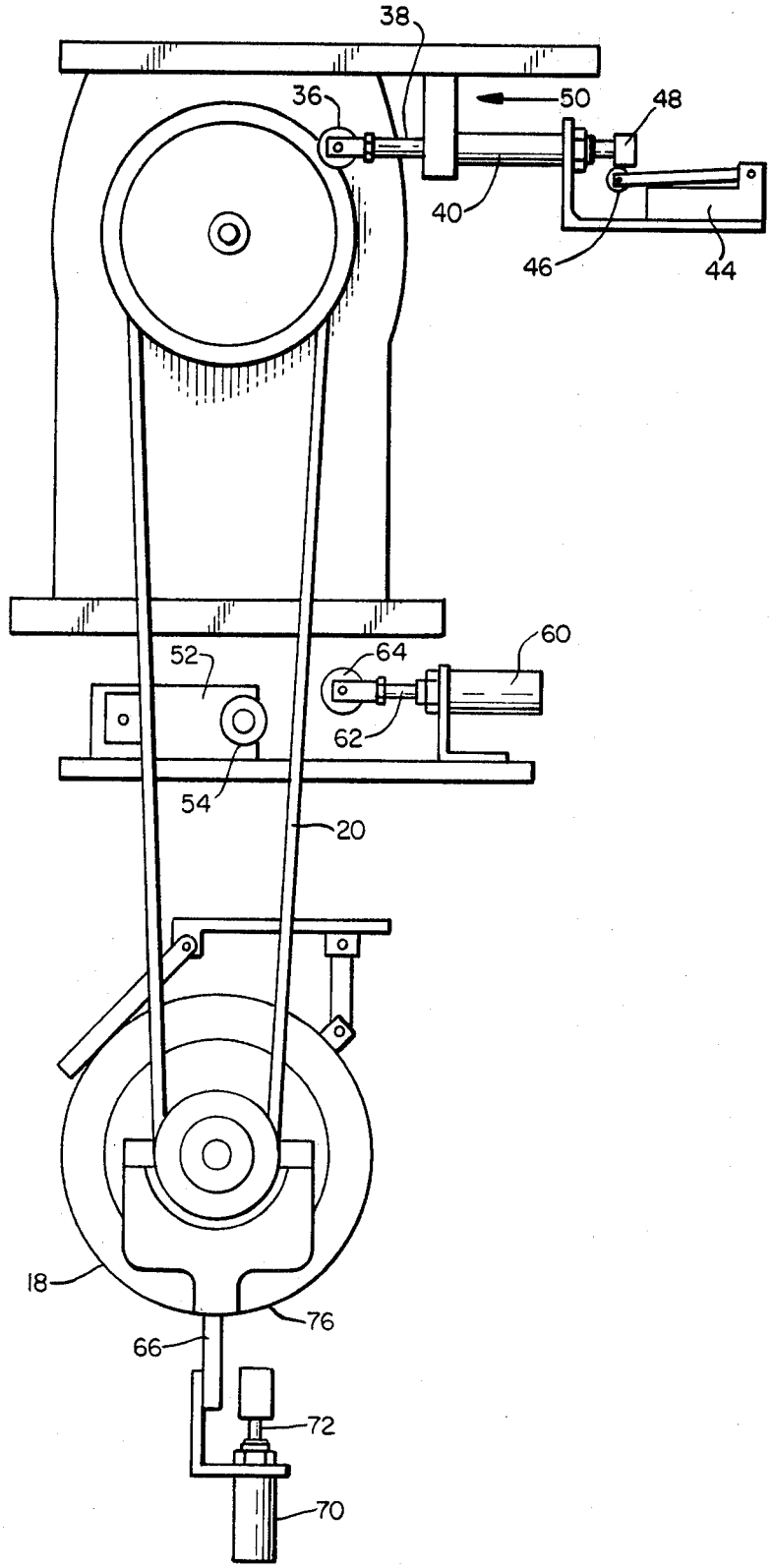
FIG. 3 is a side elevational view similar to FIG. 1 illustrating the positioning of the needle and the disengagement of the needle positioning motor.

Referring now to FIGS. 2 and 3 the operation and sequencing of the needle positioner will be described in greater detail. Once the sewing machine operator has sewn the garment to the desired length the operator heels back on the treadle thereby stopping the standard sewing machine motor 18 which stops the rotation of handwheel 24. In the case of automatically controlled machinery the same process takes place resulting in the cessation of sewing operation. The stopping of the sewing machine 12 by sewing machine motor 18 and the heeling back by the operator or upon reaching a predetermined point in a programmed sewing cycle results in the extension of piston 38 of the handwheel position sensing means in the direction of arrow 50 to result in the contact of roller 36 in the outer circumferential surface of handwheel 24.

Piston 62 is activated by the opening of a valve to admit air under pressure in cylinder 60 automatically at the end of the sewing cycle or by heeling the back on the sewing machine pedal to extend roller 64 to bias and bend V-belt 20 around a portion of the circumference of pulley 54 of pneumatically activated needle positioning motor 52. Cylinder 70 is also activated to extend piston 72 to bias supporting head 74 against electric motor housing surface 76 to disengage or relax brake assembly 66. Pneumatically controlled air motor 52 is then activated by a value to drive V-belt 20 to turn handwheel 24 to position the needle in the sewing cycle by the location by roller 36 of indentation 28 on handwheel 24. It will be recognized that the coaction between needle positioning motor 52 and cylinder 60 provides a sinesoidal shaped bending of V-belt 20 around more of the surface area of pulley 54. The increase in the surface area of pulley 54 assists in more efficiently allowing the operation of pulley 54 and the pneumatically controlled needle positioning motor 52 to position the sewing needle in a predetermined point in the sewing cycle.

The location of indentation 28 by roller 36 results in the further travel of piston 38 in the direction of arrow 50 (FIG. 3). The complete extension of piston 38 into indentation 28 which corresponds to a particular position of the needle in the sewing cycle results in the contact of roller 46 on switch 44 by contact 48 on the end of piston 38. The closing of switch 44 by the contact of roller 46 with contact 48 results in the actuation of a value and the disengagement of pulley 54 of air motor 52 by the retraction of piston 62 into cylinder 60 thereby removing roller 64 from contact against the surface of V-belt 20.

The activation of switch 44 preferrably also results in the retraction of piston 72 into cylinder 70 by the admission of air under pressure to remove supporting head 74 from its contact with housing surface 76 of electric motor 18. This results in the reactivation of the brake in the standard brake arm and clutch assembly of sewing machine motor 18. The retraction of piston 72 into cylinder 70 preferrably closes a further switch which activates a value and causes piston 38 to retract into cylinder 40 to thereby leave the needle in a particular predetermined position in the sewing cycle and the return of the sewing machine back to its pre-sewing configuration and ready for the initiation of further sewing operation or the removal of the garment. At this point in time the garment may be removed from the machine where the needle is positioned completely out of the garment or the garment may thercafter be turned or otherwise oriented where the needle is positioned in the garment for further sewing where desired.

Figure 4:
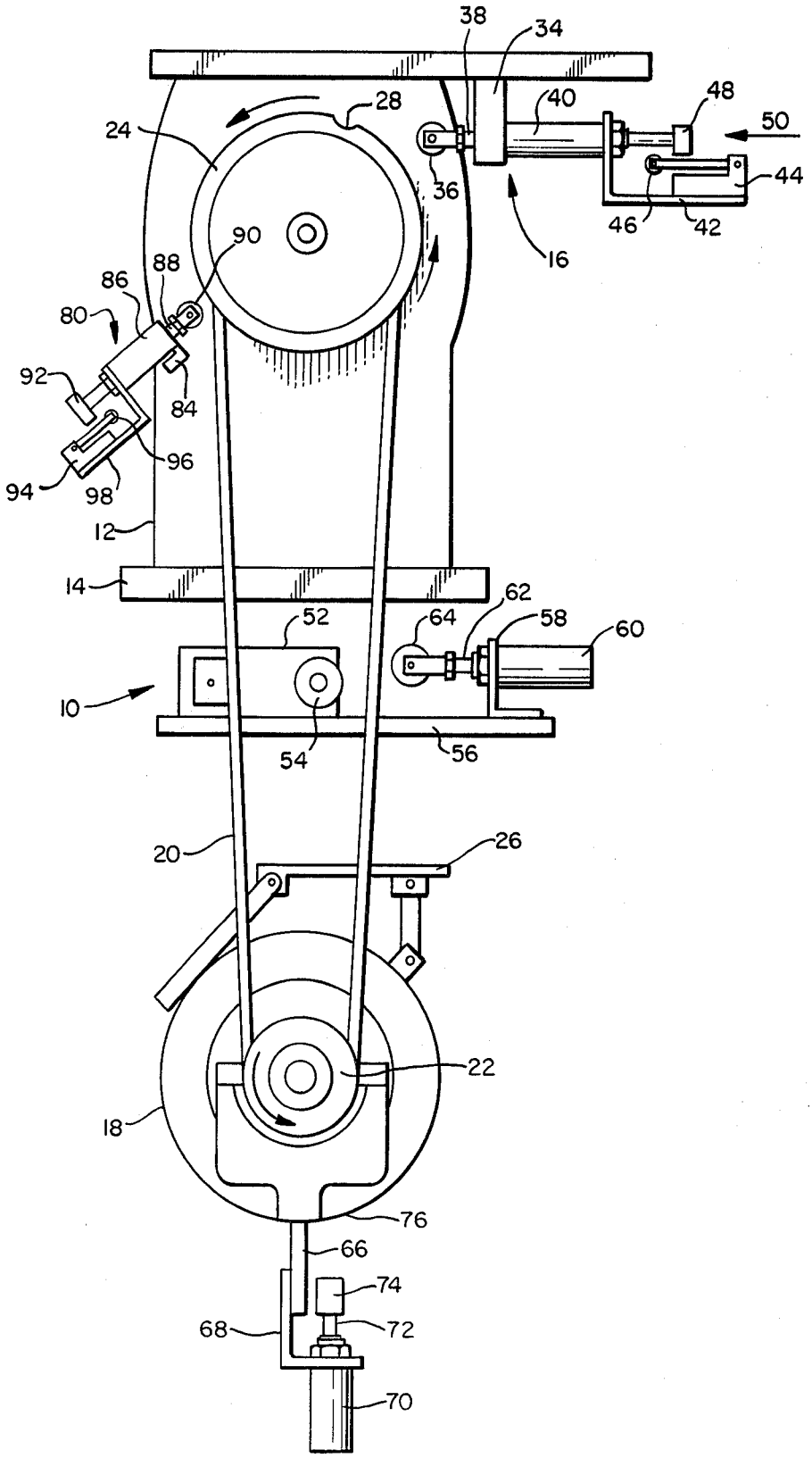
FIG. 4 is a side elevational view similar to FIG. 1 illustrating a further embodiment of the needle positioner having a two position needle positioning embodiment.

In the foregoing description of the invention a one position needle positioner which positioned the needle inside or outside of the garment or workpiece has been described. It will be recognized that a two position needle positioner for positioning the needle either inside or outside of the garment or any other number of needle positions in the sewing cycle can be constructed by either modifying the type of needle sensing device utilized or by the addition of a second sensor as is illustrated in FIG. 4. In FIG. 4 a second sewing machine handwheel position sensing means 80 may be disposed on sewing machine 12 at about 180° from the first handwheel position sensing means 16. In this embodiment the disposition of the second handwheel sensing means 80 corresponds to a second needle position which is generally opposite to the first needle position provided by the first needle position sensing means. The second needle position sensing means does not have to be disposed at 180° from the first needle sensing means but is preferrably positioned so that it will upon contact with indentation 28 provide the desired needle position.

The second sensing means 80 may be conveniently attached to sewing machine 12 via a bracket 84 which supports a cylinder 86 in which a piston 88 is designed to reciprocate in either a forward or rearward direction. At one end of piston 88 is a handwheel biasing roller 90 for engaging the circumferential surface of handwheel 24 in a manner similar to roller 36 of handwheel position sensing means 16. At the opposite end of piston 88 is a contact 92 for closing a contact switch 94 having a roller 96 which is supported by a bracket 98 attached to cylinder 86.

The operation of second sensing means 80 is the same as the first sensing means 16 except that sensing means 80 is disposed on sewing machine 12 at a position that corresponds to the position of the needle being opposite to the position of the needle provided by the first sensing means. In this manner the operator or the program of an automated sewing machine may be designed to provide a sewing machine capable of positioning the needle fully into the fabric or fully out of the fabric at the end of the sewing cycle. Sensing means 80 is therefore an alternative sensing means which would be utilized for providing information as to the alternative position of the needle in the sewing cycle. Consequently in the same manner either sensing means 80 or sensing means 16 would be utilized in conjunction with the operation of the needle positioning motor 52, cylinder 60 and cylinder 70 to result in the positioning of the needle either completely inside the fabric or completely outside the fabric as is desired by the sewing machine operator or program operating an automated sewing machine.

In alternative embodiments where a two position needle positioner is desired a second handwheel may also be employed with a separate sensing means to provide information as to the position of the needle in the sewing cycle. The desired position of the needle may be achieved by the activation of the first or second needle positioning device by the operator or a computerized program of the sewing machine to assure that the position of the needle is inside the fabric or outside the fabric at the end of a particular sewing operation.

In either embodiment the handwheel sensing means provides information as to the position of the needle in the sewing cycle and cooperates with the pneumatically powered needle positioning motor to position the needle inside or outside the fabric in the sewing cycle.

Figure 5:
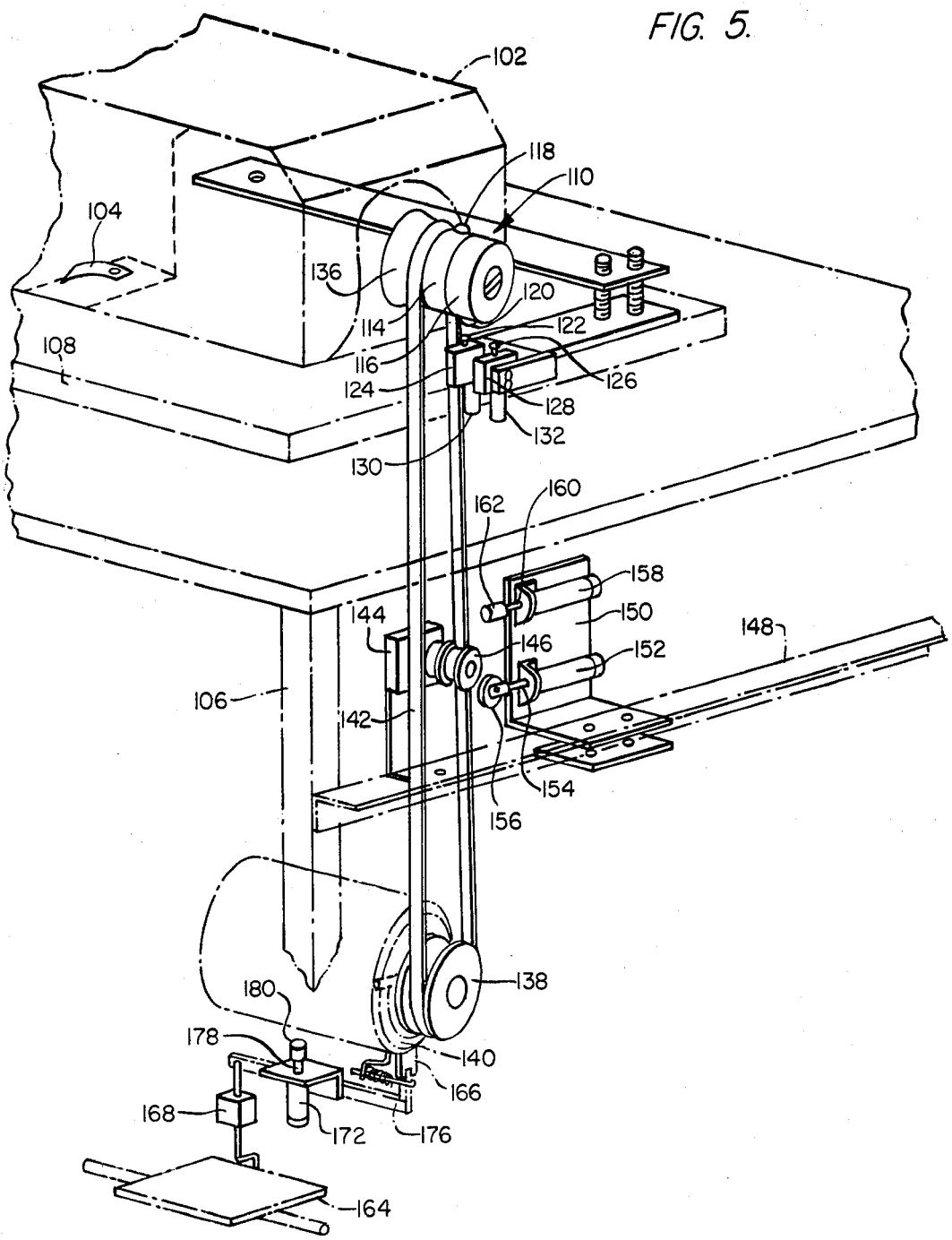
FIG. 5 is a side perspective elevational view illustrating an arrangement for the needle positioner including the disposition of a needle positioning motor with respect to an over-edge sewing machine and drive motor in the sewing configuration.
Figure 6:
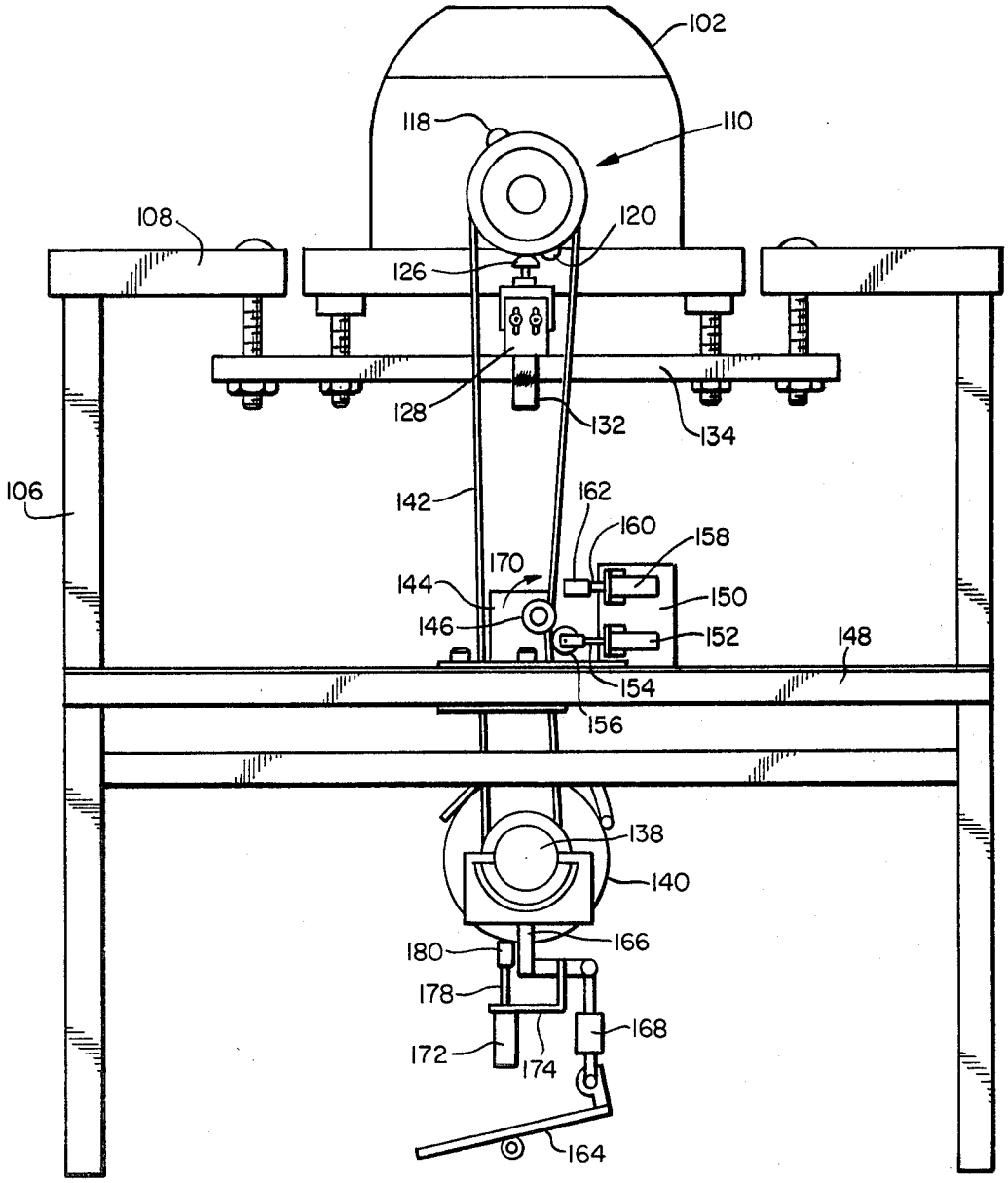
FIG. 6 is a side elevational view of an over-edge sewing machine illustrating the arrangement of the needle positioning motor and the positioning operation of the needle positioner.
Figure 7:
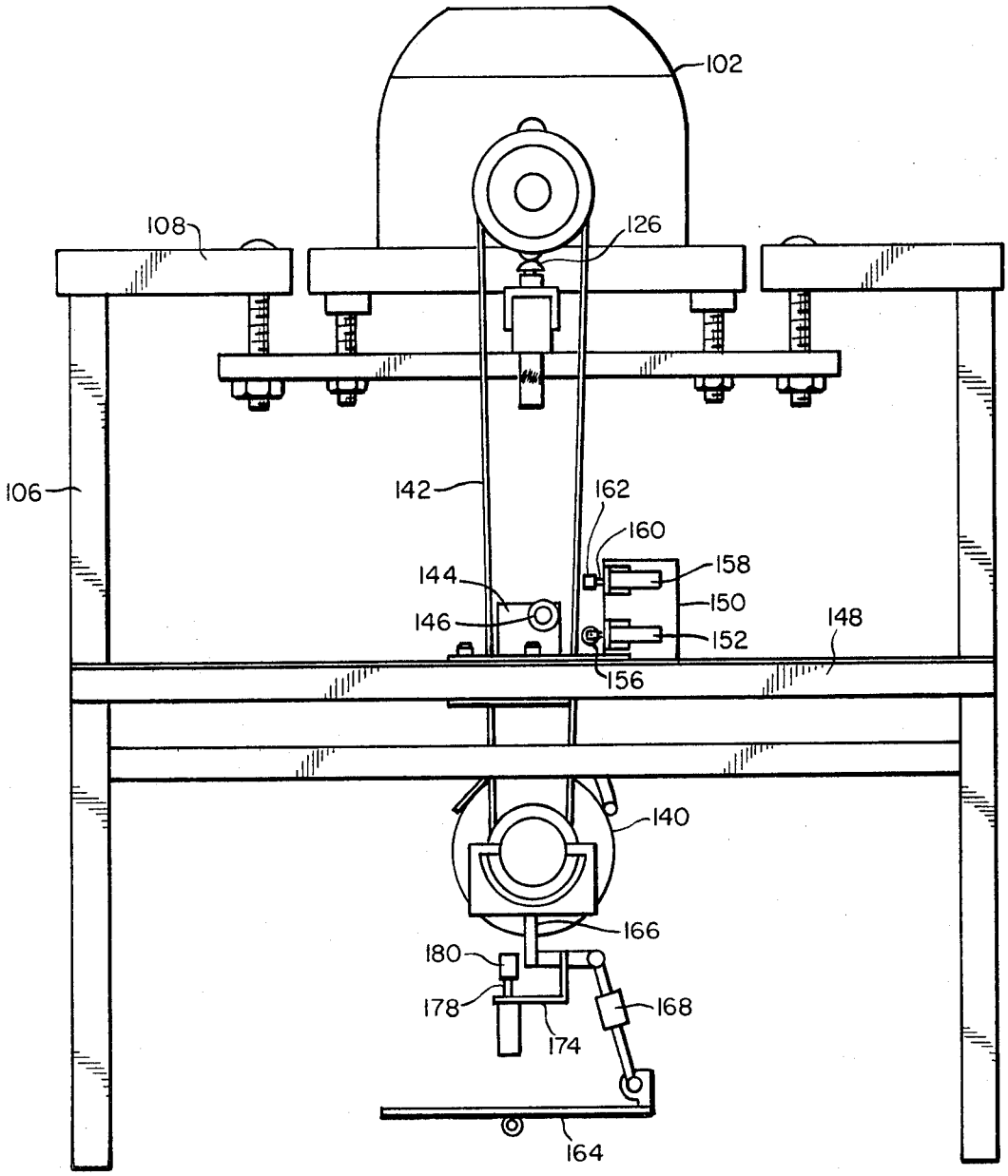
FIG. 7 is a side elevational view of the over-edge sewing machine similar to FIG. 6 illustrating the needle positioner in the sewing configuration.

The application of the present needle positioner is readily adapted for mounting to a variety of sewing and stitching machines. In FIGS. 5–7 the novel needle positioner is utilized in a standard over-edge stitching machine to position the needle in a predetermined position in the stitching cycle. In FIG. 5 an over-edge stitching machine 102 having a stitching needle 104 is supported by frame 106 having a mounting platform table top 108.

The needle positioner illustrated in FIGS. 5–7 is a two position needle positioner which is designed to position needle 104 either in the workpiece or outside the workpiece. The positioning of needle 104 is accomplished by employing a modified handwheel 110 which may be a solid element but preferrably is composed of two adaptor wheels 114 and 116 which assists in setting up two positions for the stitching needle 104. Wheel 114 includes a cam wheel button 118 and wheel 116 similarly includes a cam wheel button 120. Cam wheel button 118 in conjunction with mushroom stem 122 of a four way indented valve 124 provides a first means for determining a first position of needle 104. Similarly cam wheel button 120 in conjunction with mushroom stem 126 of a second four way indented valve 128 provides a second means for determining a second position of needle 104.

Four way indented valves 124 and 128 each include snap reset pilots 130 and 132 respectively for selective activation of mushroom stems 122 and 126 in a manner which will be described hereinafter in greater detail. Four way indented valves 124 and 128 are supported on a radial adjacent to wheels 114 and 116 on support 134.

A pulley 136 is disposed axially adjacent to adaptor wheels 114 and 116 which is connected to pulley 138 of stitching machine drive motor 140 by V-belt 142. A needle positioning motor 144 having a pulley 146 is disposed intermediate pulley 136 and 138 on support 148 of frame 106. Pulley 146 is disposed adjacent to and on one side of V-belt 142 so that in the sewing configuration V-belt 142 is not in contact with pulley 146. (FIG. 7). Adjacent to pulley 146 and on the other side of V-belt 142 a mounting bracket 150 is disposed on support 148. Mounting bracket 150 includes a belt clamp cylinder 152 for activating a piston 154 having a roller 156 disposed theron for bending V-belt 142 around a portion of the circumference of pulley 146 for positioning needle 104. Mounting bracket 150 also supports a positioner brake cylinder 158 for activating a piston 160 having a positioner brake stop 162.

Stitching machine drive motor 140 drives pulley 136 to drive the over-edge stitching machine 102 by depressing foot pedal 164 which is illustrated in the sewing configuration in FIGS. 5 and 7. The heeling back of pedal 164 results in the application of pressure by brake assembly 166 to motor 140 to stop the rotation of pulley 138. After a delay a signal is given to a two position air switch 168 which may be activated by a further heeling back of pedal 164 in one of two positions. One position of pedal 164 results in two position air switch 168 sending a signal to snap reset pilot 130 for the activation of either mushroom stems 122 to position the needle in for example a down position. Similarly the up position of the needle can be provided by two position switch 168 sending a signal to snap reset pilot 132 for the activation of mushroom stem 126. The activation of snap reset pilot 130 or 132 depends upon the desired position of needle 104.

Upon the activation of either snap reset pilot 130 or 132 needle positioning motor 144 is activated resulting in the rotation of pulley 146 in the direction of arrow 170 (FIG. 6). Belt clamp cylinder 152 is actuated resulting in roller 156 contacting and bending V-belt 142 around a portion of the circumference of pulley 146. Simultaneous with the bending of V-belt 142 around pulley 146, cylinder 172 is activated which is supported by a bracket 174 which is mounted on arm 176 of brake assembly 166, along with piston 178 which is activated to extend motor brake release shoe 180 against housing of motor 140 to release the brake of stitching machine motor 140 (FIG. 6). Needle positioning motor 144 continues to rotate V-belt 142 until either cam wheel button 118 contacts mushroom stem 122 or cam wheel button 120 contacts mushroom stem 126 to position needle 104 in an up or down position depending on the selected position of the two position air switch 168.

Figure 8:
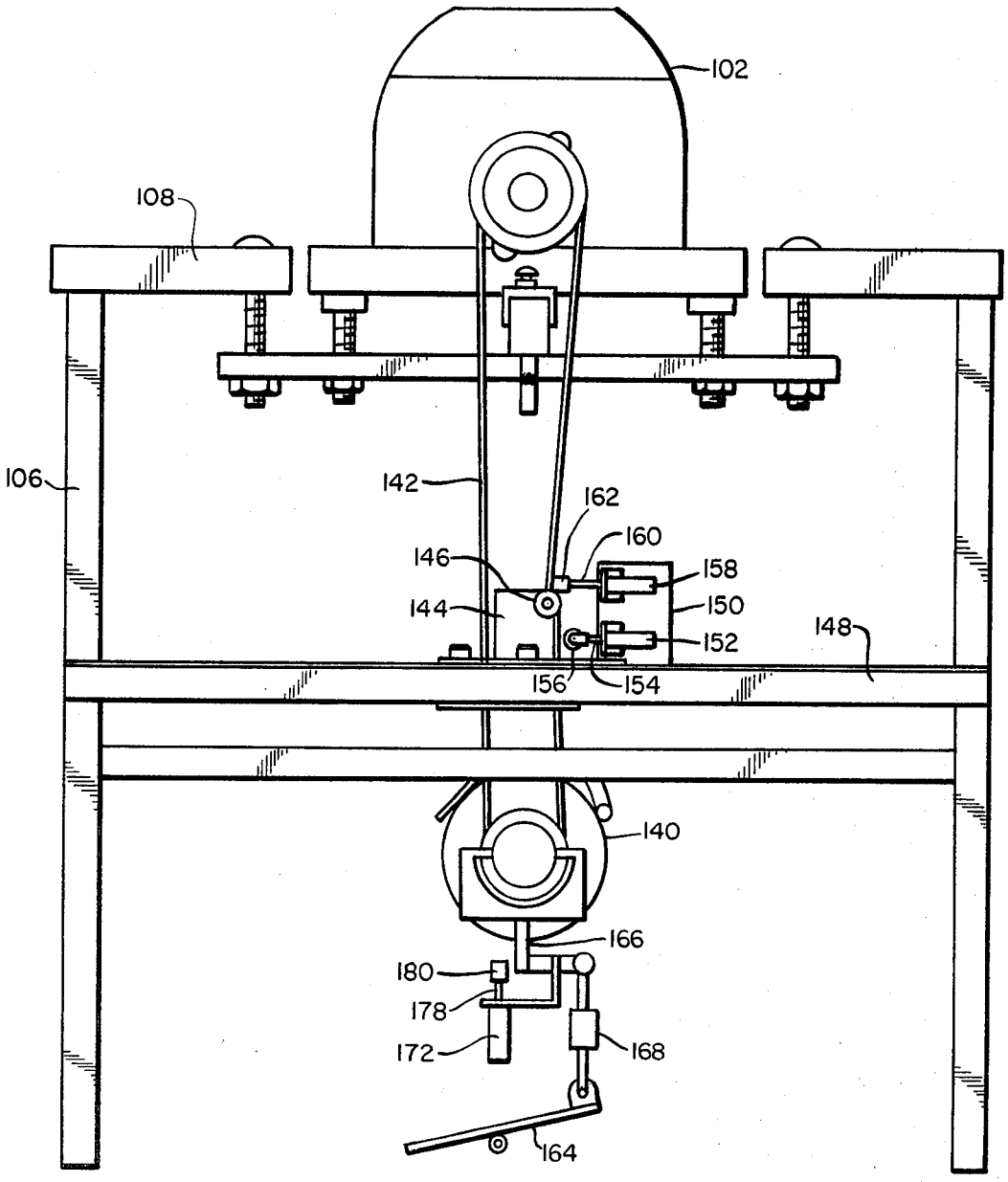
FIG. 8 is a side elevational view of the over-edge sewing machine similar to FIG. 7 illustrating a stop position achieved by bending the V-belt around a portion of the circumference of the needle positioning motor pulley with the positioner brake shoe.

The contact of mushroom stem 122 or 126 results in the deactivation of needle positioning motor 144 and the retraction of piston 178 in cylinder 172 to reapply the brake of stitching machine motor 140 (FIG. 8). Piston 154 is retracted in cylinder 152 to release V-belt from pulley 146 and cylinder 158 is activated to extend piston 160 and positioner brake stop 162 to bend and lock V-belt 142 against pulley 146 of needle positioner motor 144 (FIG. 8). In FIG. 8 the stitching machine is in the stop position with needle 104 positioned in the DOWN position for the turning or further processing of the garment or with the needle in the UP position to receive another garment after the completion of the stitching cycle.

In operation the electric motor and handwheel sewing machine combination and standard V-belt pulley connection employed in industrial sewing machine equipment is utilized with the novel needle positioner. The combination of the present invention is particularly advantageous since it is economical, easy to install and provides a positive means for controlling the position of the needle in the sewing cycle. More particularly sewing machines modified in accordance with the present invention only require the removal of the standard handwheel and/or the modification of an existing handwheel to provide an apparatus and method for accurately positioning the needle in the sewing cycle. This basically involves a calibration of or a marking of the sewing machine handwheel to provide a positive indication as to the position of the needle in the sewing cycle and thereafter a single means or multiple means to position the needle at a predetermined point in the sewing cycle.

It will further be recognized that the advantages of the present invention include a pneumatically powered needle positioning motor which is engaged only at such time as the sewing cycle has been completed and the electric sewing machine motor has been disengaged. As a result there is no requirement for a clutch in the needle positioning motor or that the needle positioning motor be free floating, nor is there obstruction of the normal operation of the equipment. In accordance with the method of the present invention the operation of the sewing machine is allowed to continue unfettered until such time as the sewing operation has been completed and thereafter utilizing a V-belt biasing roller with a piston and cylinder combination to bend the V-belt around a portion of the circumference of a pulley on the pneumatically controlled needle positioning motor to turn the V-belt combination until the handwheel sensing means locates a predetermined position on the handwheel to indicate a predetermined position of the needle in the sewing cycle. In most of the prior art sewing machines it is preferable to first release the brake of the sewing machine motor before activating the needle positioning motor. In any event once the predetermined position of the needle in the sewing cycle is achieved a further switch is activated which deactivates the V-belt biasing roller piston and cylinder combination.

The novel needle positioner of the present invention provides a more readily adaptable and modifiable arrangement of components than prior art needle positioning devices and is more readily adaptable to a variety of equipment that is already in service as well as the addition of the novel needle positioner to new equipment. In addition the arrangement and disposition of the parts insure a more economical and trouble free system of operation since the component parts do not interfere with the normal operation of the sewing machine or the driving motor until such time as the needle positioning device is activated. As a result there is no requirement that the needle positioner motor must alternatively operate in a free flowing and then power configuration nor is there the necessity for utilizing clutch assemblies for the activation and deactivation of the needle positioner.

The novel design and utilization of components of the present needle positioner not only reduces the complexity of existing needle positioning systems but also is readily adaptable to existing equipment. For example, the present invention is easily adaptable to existing equipment particularly where the existing equipment already utilizes pneumatically driven components for other functions of the sewing machine. The utilization of the novel needle positioner of the present invention therefore provides valuable economic alternatives to needle positioning devices heretofore available in the prior art.

As will be recognized by those skilled in the art the present invention has a wide range of applicability to other types of sewing machines and stitching equipment and may be modified in a variety of ways by utilizing other types of sensing mechanisms for sensing the position of the handwheel or needle in the operation of the sewing machine. It will be further recognized by those skilled in the art that the novel needle positioner may be disposed at other locations in the motor pulley, handwheel, V-belt combination and may be disposed inside or outside the outside surface area of the V-belt to achieve the advantages of the present invention. It will further be appreciated that the invention may be implemented in a variety of ways to suit particular requirements of the sewing machine or stitching equipment and to utilize various forms of sensing devices for sensing the position of the needle in the sewing cycle. Consequently, it is intended that these and other modifications and applications of the invention to a variety of sewing and stitching operations may be made within the spirit and scope of the invention as defined in the following claims.

What is claimed is:

1. A pneumatically controlled needle positioner for positioning a needle in relation to a workpiece comprising:

(a) means for sensing a position of a sewing or stitching machine handwheel wherein said handwheel is calibrated in relation to the position of a machine needle in the sewing or stitching cycle;

(b) a pneumatically operated needle positioning motor disposed intermediate a sewing or stitching machine motor drive pulley and said machine handwheel;

(c) a needle positioning motor pulley disposed on said pneumatically operated needle positioning motor and adjacently spaced to one side of a drive belt connecting said sewing machine drive pulley and said machine handwheel;

(d) means disposed on the other side of said drive belt for biasing said drive belt around a portion of the circumference of said needle positioning motor pulley; and (e) control means for activating and deactivating said pneumatically operated needle positioning motor, said means for sensing the position of said machine handwheel and said means for biasing said drive belt against said needle positioning motor pulley.

2. The pneumatically controlled needle positioner for positioning a needle in relation to a workpiece of claim 1 further comprising means for releasing a brake provided on the sewing machine drive motor.

3. The pneumatically controlled needle positioner for positioning a needle in relation to a workpiece of claim 2 wherein said means for releasing said brake comprises a piston and cylinder disposed on the brake arm extendable to the housing of said sewing machine drive motor to release said brake.

4. The pneumatically controlled needle positioner for positioning a needle in relation to a workpiece of claim 2 wherein said means for sensing a position of said sewing machine handwheel comprises an indentation on said handwheel in cooperation with a cylinder and piston in combination with a switch for locating said indentation.

5. The pneumatically controlled needle positioner for positioning a needle in relation to a workpiece of claim 2 further comprising a second means for sensing a second position on a sewing machine handwheel which is calibrated in relation to a second position of a sewing machine needle in said sewing cycle.

6. The pneumatically controlled needle positioner for positioning a needle in relation to a workpiece of claim 4 wherein said second means for sensing a second position on said sewing machine handwheel comprises a second cylinder and piston in combination with a switch for locating said indentation.

7. The pneumatically controlled needle positioner for positioning a needle in relation to a workpiece of claim 2 wherein said means disposed on the other side of said drive belt for biasing said drive belt against said needle positioning motor pulley comprises a cylinder and piston combination wherein said piston includes a roller for biasing and bending said belt against said needle positioning pulley.

8. The pneumatically controlled needle positioner for positioning a needle in relation to a workpiece of claim 7 wherein said roller disposed on said piston of said means disposed on the other side of said drive belt for biasing and bending said drive belt against said needle positioning motor pulley is not in center alignment with said needle positioning motor pulley.

9. The pneumatically controlled needle positioner for positioning a needle in relation to a workpiece of claim 8 wherein said roller disposed on said piston is about ¾th of an inch out of center alignment with said needle positioning motor pulley.

10. The pneumatically controlled needle positioner for positioning a needle in relation to a workpiece of claim 9 wherein said needle positioning motor pulley is driven by a 3 to 1 gear ratio.

11. The pneumatically controlled needle positioner for positioning a needle in relation to a workpiece of claim 2 wherein said control means activates said pneumatically controlled needle positioner after completion of the sewing operation by activating said means for sensing a position on a sewing or stitching machine handwheel, said means for releasing the brake of said sewing machine drive motor, said biasing means and said pneumatically operated needle positioning motor and operating said needle positioning motor until said position sensing means locates said position on said sewing or stitching machine handwheel and thereafter deactivating said pneumatically operated needle positioning motor, said biasing means, said brake of said sewing machine drive motor and said means for sensing a position on said sewing machine handwheel.

12. The pneumatically controlled needle positioner for positioning a needle in relation to a workpiece of claim 1 further comprising a second means for sensing a second position of a sewing or stitching machine handwheel which is calibrated in relation to a second position of the machine needle in the sewing or stitching cycle.

13. The pneumatically controlled needle positioner for positioning a needle in relation to a workpiece of claim 12 wherein said first and said second means for sensing said positions of said sewing or stitching machine handwheel comprises a first cam and a second cam disposed on axially adjacent positions on said handwheel and wherein said first and second cams are disposed radially adjacent a first and second four way valve.

14. The pneumatically controlled needle positioner for positioning a needle in relation to a workpiece of claim 13 wherein said first and said second cams are disposed on a first and second axially adjacent handwheel.

15. The pneumatically controlled needle positioner for positioning a needle in relation to a workpiece of claim 13 further comprising a two position air switch for selectively activating said first and said second four way valve.

16. The pneumatically controlled needle positioner for positioning a needle in relation to a workpiece of claim 12 further comprising a needle positioner brake stop for bending said drive belt around a portion of the circumference of said pulley and locking said belt in relation thereto.

17. A pneumatically activated needle positioner for positioning a stitching needle relative to a workpiece comprising:

(a) means for determining the position of a stitching machine needle in the stitching cycle;

(b) a pneumatically operated needle positioning motor having a pulley disposed in a spaced relationship adjacent to one side of a drive belt connecting a stitching machine drive motor with a stitching machine handwheel;

(c) means disposed on the other side of said drive belt for biasing said drive belt against said pulley disposed on said pneumatically operated needle positioning motor; and (d) control means for activating and deactivating said pneumatically operated needle positioning motor, said means for determining the position of a stitching machine needle in the stitching cycle and said means for biasing said drive belt against said pulley disposed on said pneumatically operated needle positioning motor.

18. The pneumatically activated needle positioner for positioning a stitching needle relative to a workpiece of claim 17 further comprising means for releasing a brake provided on the stitching machine drive motor.

19. The pneumatically activated needle positioner for positioning a stitching needle relative to a workpiece of claim 18 wherein said means for determining the position of a stitching needle comprises a stitching machine handwheel calibrated in relation to the position of a stitching needle in the stitching cycle.

20. The pneumatically activated needle positioner for positioning a stitching needle relative to a workpiece of claim 18 wherein said means disposed on the other side of said drive belt for biasing said drive belt against said pulley comprised a cylinder and piston combination wherein said piston includes a roller for biasing said belt against said pulley of said pneumatically operated needle positioning motor.

21. The pneumatically activated needle positioner for positioning a stitching needle relative to a workpiece of claim 20 further comprising a needle positioner brake stop for bending said drive belt around a portion of the circumference of said pulley and locking said belt in relation thereto.

22. The pneumatically activated needle positioner for positioning a stitching needle relative to a workpiece of claim 18 wherein said control means activates said means for determining the position of the sewing machine needle after completion of the sewing operation, said means for releasing said brake, said biasing means and said pneumatically operated needle positioning motor and operating said needle positioning motor until said means for determining the position of the sewing machine needle positions said needle in a predetermined position and said control means thereafter deactivates said pneumatically operated needle positioning motor said biasing means, said means for releasing said brake and said means for determining the position of said sewing machine needle.

23. A method of pneumatically positioning a needle in relationship to a workpiece in a sewing or stitching cycle comprising:

(a) stopping the sewing or stitching machine motor;

(b) engaging a means for sensing a position of a sewing or stitching machine handwheel which is calibrated in relation to the position of the machine needle in the sewing or stitching cycle;

(c) pneumatically biasing the sewing or stitching machine drive belt with means for biasing and bending said drive belt around a portion of the circumference of the drive belt pulley disposed on a pneumatically controlled needle positioning motor;

(d) turning said pneumatically controlled needle positioning motor until said means for sensing the position of said handwheel locates a predetermined position on said handwheel corresponding to a predetermined position of said sewing machine needle in said sewing or stitching cycle; and (e) disengaging said means for sensing a position of a sewing or stitching machine handwheel, said means for penumatically biasing and bending said sewing machine drive belt and said pneumatically controlled needle positioning motor.

24. The method of pneumatically positioning a needle in relationship to a workpiece in a sewing or stitching cycle of claim 23 further comprising the step of releasing a brake provided on said sewing or stitching machine motor after stopping said machine motor.

25. The method of pneumatically positioning a needle in relationship to a workpiece in a sewing or stitching cycle of claim 23 further comprising the step of providing a two position needle positioner by employing a second means for sensing the position of a sewing or stitching machine handwheel which is calibrated in relation to a second position of a machine needle in the sewing or stitching cycle.

* * * * *